US006666124B2

(12) United States Patent
Fleming

(10) Patent No.: US 6,666,124 B2
(45) Date of Patent: Dec. 23, 2003

(54) FAST DEPLOYMENT, HIGH PRESSURE INFLATABLE PANELS AND WATERCRAFT OR OTHER OBJECTS WITH ARMOR OR OTHER PROTECTION

(75) Inventor: Timothy Fleming, Paris (FR)

(73) Assignee: Zodiac Hurricane Technologies, Inc. (CA)

( * ) Notice: Subject to any disclaimer, the term of this patent is extended or adjusted under 35 U.S.C. 154(b) by 0 days.

(21) Appl. No.: 10/154,168

(22) Filed: May 23, 2002

(65) Prior Publication Data

US 2003/0217638 A1 Nov. 27, 2003

(51) Int. Cl.[7] ..... B63G 3/10

(52) U.S. Cl. ..... 89/36.12; 89/36.02; 114/10; 114/14; 114/345

(58) Field of Search ..... 89/36.02, 36.12; 114/9–14, 4, 345, 123

(56) References Cited

U.S. PATENT DOCUMENTS

| | | | | |
|---|---|---|---|---|
| 1,288,967 | A | * 12/1918 | Nobis | |
| 1,686,366 | A | * 10/1928 | Boyle | |
| 2,334,072 | A | * 11/1943 | Cooper | |
| 2,508,304 | A | * 5/1950 | Sturtevant | |
| 3,745,938 | A | 7/1973 | Hathaway et al. | |
| 3,813,281 | A | 5/1974 | Burgess et al. | |
| 4,640,217 | A | 2/1987 | Ferronniere | 114/345 |
| 4,822,657 | A | * 4/1989 | Simpson | 89/36.02 |
| 5,059,467 | A | * 10/1991 | Berkovitz | 89/36.02 |
| 5,113,779 | A | * 5/1992 | Amrein et al. | 114/270 |
| 5,200,256 | A | 4/1993 | Dunbar | |
| 5,739,458 | A | * 4/1998 | Girard | 89/36.02 |
| 5,769,022 | A | * 6/1998 | Luxford | 114/361 |
| 5,942,716 | A | * 8/1999 | Miller | 89/36.17 |
| 6,029,558 | A | 2/2000 | Stevens et al. | |
| 6,128,999 | A | * 10/2000 | Sepp et al. | 89/36.17 |
| 6,318,287 | B1 | 11/2001 | Klimenko | 114/345 |
| 6,394,018 | B1 | 5/2002 | Klimenko | 114/345 |
| 6,439,100 | B1 | * 8/2002 | Jung et al. | 89/36.01 |
| 6,470,784 | B1 | * 10/2002 | Bonavita et al. | 89/36.17 |
| 2002/0053279 | A1 | 5/2002 | Jung et al. | |
| 2002/0053314 | A1 | 5/2002 | De Quatrebarbes | |

FOREIGN PATENT DOCUMENTS

GB 2 001 586 A * 2/1979

* cited by examiner

*Primary Examiner*—Stephen M. Johnson
(74) *Attorney, Agent, or Firm*—Dean W. Russell; Kilpatrick Stockton LLP

(57) ABSTRACT

Armored protective panels for inflatable (and other) boats are detailed. The panels themselves may be inflated, either separately or together, for deployment and hence need not normally impede navigation or performance of the boats. If relatively flexible anti-ballistic materials are selected as components, the panels may be designed to collapse into rolls when not inflated. Alternative panels may include stealth or other non-anti-ballistic materials or be designed for use with objects or vehicles other than boats.

25 Claims, 6 Drawing Sheets

FAST DEPLOYMENT, HIGH PRESSURE INFLATABLE PANELS AND WATERCRAFT OR OTHER OBJECTS WITH ARMOR OR OTHER PROTECTION

FIELD OF THE INVENTION

This invention relates generally to armored or otherwise protected objects and more particularly to inflatable boats or other vehicles or objects with anti-ballistic panels or other shields that are inflatable for use.

BACKGROUND OF THE INVENTION

U.S. Pat. No. 4,640,217 to Ferronniere ("the Ferronniere patent"), incorporated herein in its entirety by this reference, details aspects of exemplary pneumatic, or inflatable, boats. As described in the Ferronniere patent, versions of these boats may include one or more inflatable tubes forming a bow and generally parallel legs between which a rigid floor may be located. Each leg may comprise both an upper and a lower compartment, to which a lateral canvas may be fixed tangentially.

Among purposes of the boats of the Ferronniere patent is to carry "large useful loads in a lifted-off configuration, i.e. at high speed and with optimum efficiency." See Ferronniere, col. 2, 11. 44–46. These boats are especially (although not exclusively) suited for military and law-enforcement operations, in which substantial numbers of persons and gear often must be transported rapidly across water. Indeed, one boat made consistent with the principles of the Ferronniere patent, Zodiac's F470 watercraft, is among the most popular boats in use worldwide by military and law-enforcement personnel.

Because popularly used in this manner, these boats are likely to encounter hazards and situations dangerous to both their crews and structural integrity. In particular, bullets or other projectiles may be fired or launched at the boats and their crews by those opposing the objectives of the crews. Should the projectiles strike the crew members, injuries or deaths may occur. Should the projectiles puncture the inflatable tubes, loss of buoyancy may occur, which may impede proper functioning of the boats or, potentially, sink them.

SUMMARY OF THE INVENTION

The present invention attempts to ameliorate adverse effects associated with these hazardous operations by providing armored protective panels principally, but not exclusively, for inflatable boats. When deployed, the panels are designed to impede progress of at least some bullets or other projectiles, reducing the likelihood of their impacting either personnel within the boats or the boats themselves. Although use of the panels provides no guarantee of safety, their existence may render some situations less hazardous and improve the possibility of successful missions occurring.

Protective panels of the present invention additionally may themselves be inflatable. As a consequence, they need not always be deployed. Instead, they may remain deflated until needed, hence not normally hindering navigation or performance of the boats. Furthermore, in some embodiments of the invention the panels need not all be inflated simultaneously, hence permitting deployment of only selected panels when desired.

By choosing relatively flexible anti-ballistic materials, panels of the invention may be designed to fold or otherwise collapse into rolls when not inflated. The rolls may be fastened to the tubes (or other suitable portions) of their corresponding watercraft, using straps or other appropriate fasteners, so as to secure them in place for subsequent use. Positioning the panels in this manner maintains the general aerodynamic and hydrodynamic profiles of the boat, so that presence of the undeployed panels typically does not significantly impact navigation or speed. Likewise, even when deployed, the panels are designed so as not to impact maneuverability or speed of most vehicles appreciably.

The anti-ballistic materials may be incorporated into the panels or positioned wholly or partially within pockets formed, preferably, on exterior surfaces of the panels. If such pockets are utilized, the materials could be made to be removable and replaceable if desired. Additionally, rigid anti-ballistic materials (such as ceramic plates) could be placed in the pockets in addition, or as an alternative, to the flexible materials, although doing so might inhibit the rollable (although not necessarily the foldable) nature of the panels. Yet further, radar-absorbing ("stealth") or other energy-absorbing or non-anti-ballistic materials could be placed in the pockets (or incorporated into the panels) if appropriate or desired. As a result, the invention includes as among its features the ability to support, using inflatable components, various types of materials to provide objects with myriad kinds of protection.

It thus is a non-exclusive object of the present invention to provide protective materials for stationary or mobile objects including, but not limited to, boats.

It is another non-exclusive object of the present invention to provide armored protective panels for, particularly, inflatable boats.

It is a further non-exclusive object of the present invention to provide protective panels that may be inflated for deployment.

It is also a non-exclusive object of the present invention to provide protective panels that may collapse into rolls or folds when not deployed.

It is yet another non-exclusive object of the present invention to provide multiple protective panels inflatable separately if desired.

Other objects, features, and advantages of the present invention will be apparent to those skilled in the relevant art with reference to the remaining text and drawings of this application.

DETAILED DESCRIPTION

Figure 1:
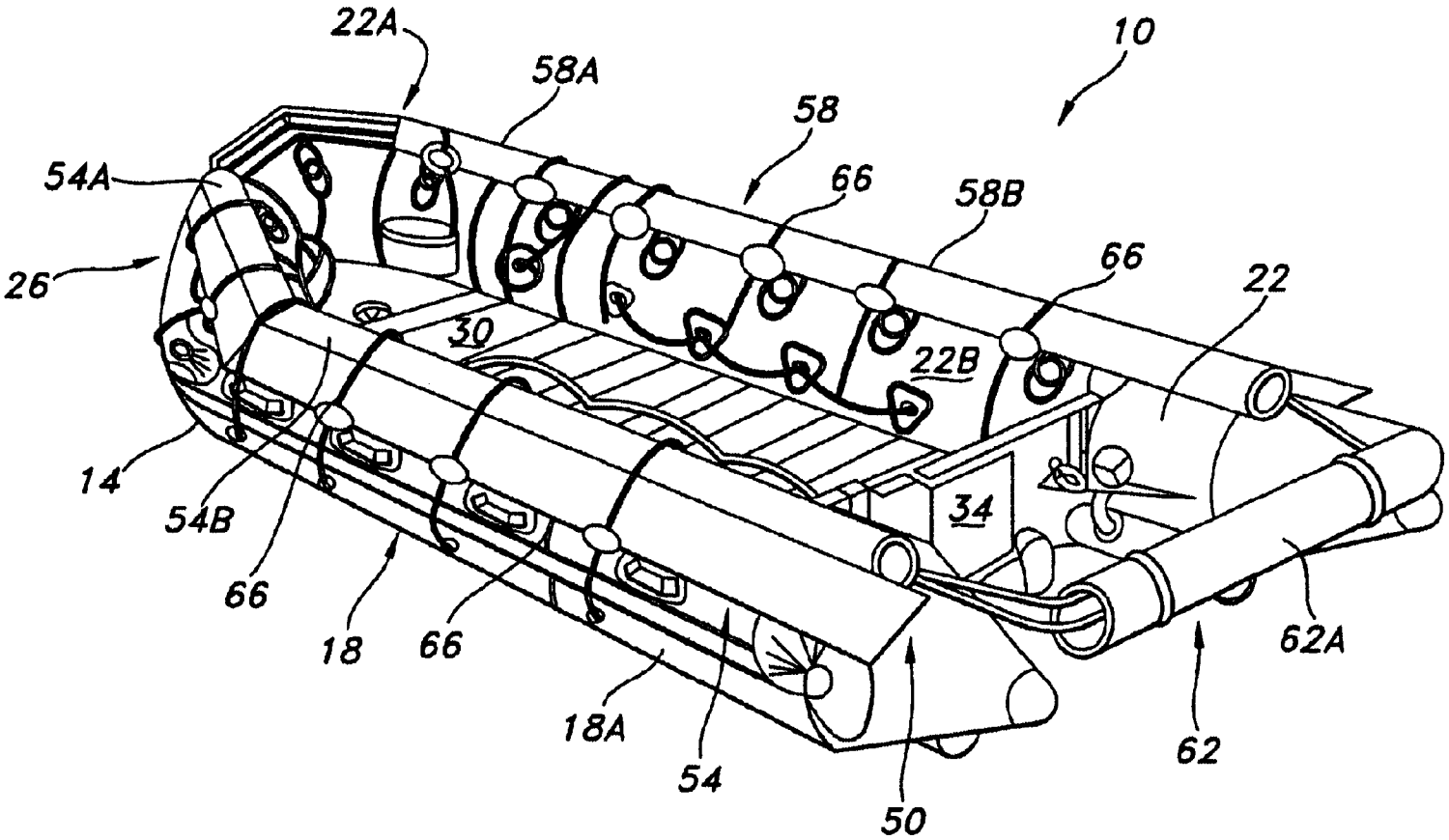
FIG. 1 is a perspective, partially-schematicized view of an exemplary watercraft with a protection system of the present invention.

Illustrated in FIG. 1 is an exemplary boat 10, which may be similar to any of those depicted in the Ferronniere patent.

Boat 10 need not be configured thusly, however, but rather may have any suitable shape and structure. Indeed, as those skilled in the art will recognize, boat 10 need not necessarily be of the pneumatic or inflatable type.

Nevertheless, boat 10 preferably is inflatable, with one or more inflatable tubes 14 defining port and starboard legs 18 and 22 and front or bow 26. Also depicted in FIG. 1 are floor 30 and transom 34, each spanning the distance between legs 18 and 22. Transom 34, positioned at or adjacent the stern of boat 10, is adapted to receive an outboard motor or similar propulsion device, while floor 30 typically is rigid to help support troops, equipment, or cargo.

Each of legs 18 and 22 defines an exterior side (18A and 22A, respectively; see also FIGS. 5–6) and an interior side (18B and 22B, respectively). As shown in FIG. 1, optional fittings, hand grips, rails, and lanyards may, if present, be glued or connected to or placed about both exterior sides 18A and 22A and interior sides 18B and 22B of legs 18 and 22. In some embodiments of boat 10, fittings in the form of D-rings advantageously will be present.

Connected to boat 10 is an exemplary protection system 50 of the present invention. System 50 may comprise side sections 54 and 58 as well as rear section 62. In some versions of the invention, system 50 may also comprise a front section, although deploying such a section may adversely impact the visibility of the pilot when boat 10 is travelling forward. Alternatively, system 50 may include only rear section 62 or only either or both of side sections 54 and 58. System 50 typically may be installed quickly and easily on boat 10, with its attachment usually sufficiently simple to permit retrofitting of existing boats.

Figure 2:
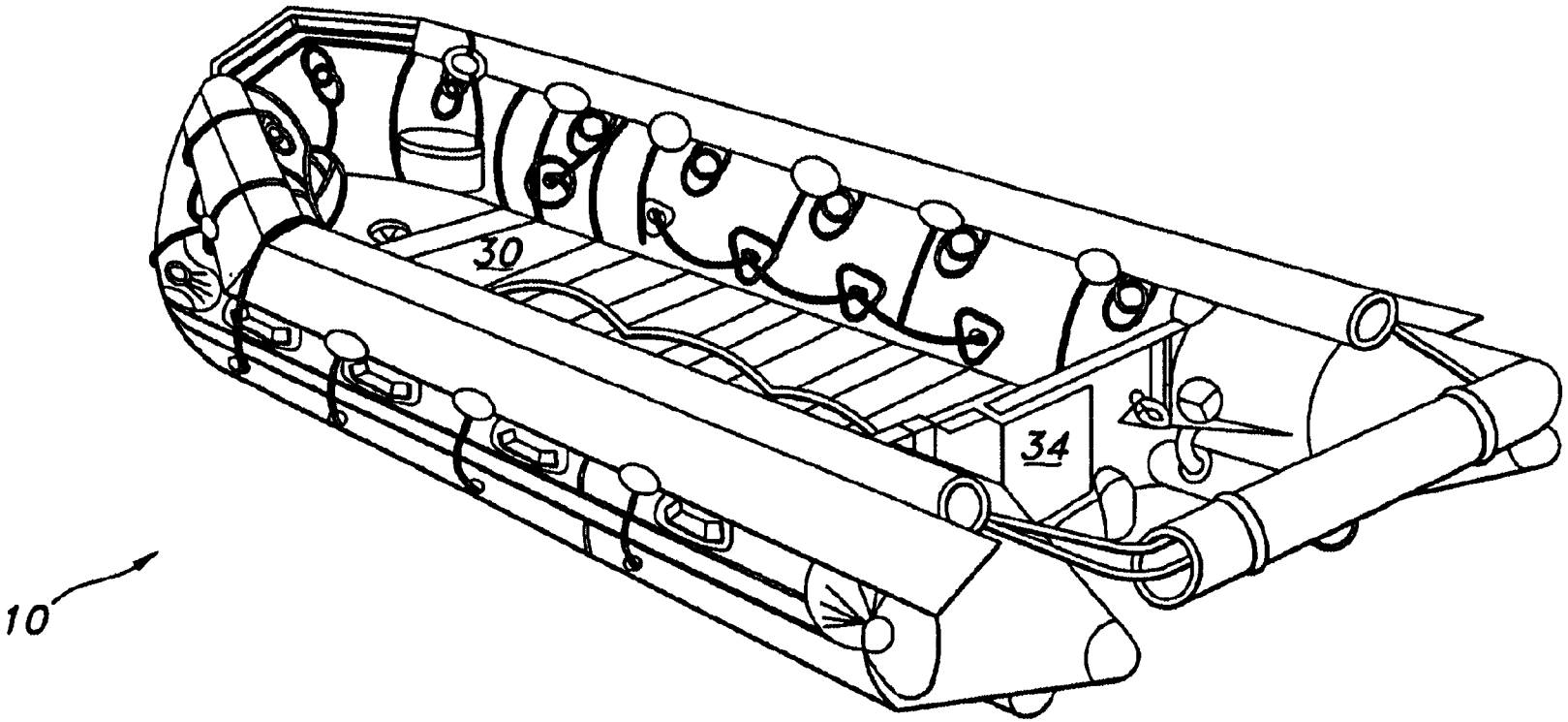
FIG. 2 is a similar view of the watercraft of FIG. 1 with the protection system prepared for deployment.

Depending on the manner in which boat 10 is configured, each side section 54 or 58 conceivably could include more than one panel. FIG. 2 illustrates two panels 54A and 54B comprising section 54, for example. Likewise, depicted in FIG. 2 are two panels 58A and 58B comprising section 58. Again, however, more or fewer panels may form either of these sections 54 or 58. Similarly, although rear section 62 beneficially may comprise a single panel 62A, multiple panels alternatively may be employed.

Figure 5:
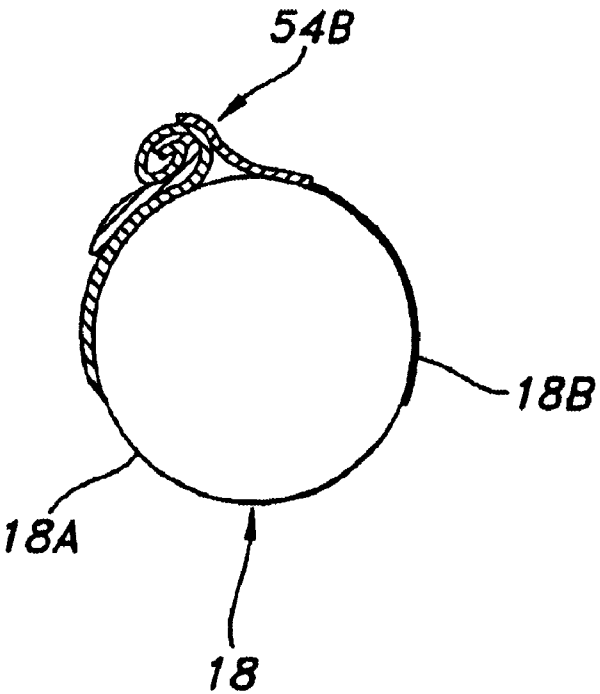
FIG. 5 is a cross-sectional, partially-schematicized view of a portion of the watercraft of FIG. 1 showing the collapsible nature of the protection system.

FIG. 1 shows system 50 in its deflated state, with each of panels 54A–B, 58A–B, and 62A collapsed. In this state, the panels 54A–B, 58A–B, and 62A may be rolled or folded for stowage until needed for use. FIG. 5 details, as an example, panel 54B collapsed into a roll generally on top of leg 18 but positioned slightly toward exterior side 18A. As so collapsed, panel 54B may be maintained in this position using straps 66 connecting to D-rings present as part of boat 10. Alternatively, other fasteners may be used.

Figure 6:
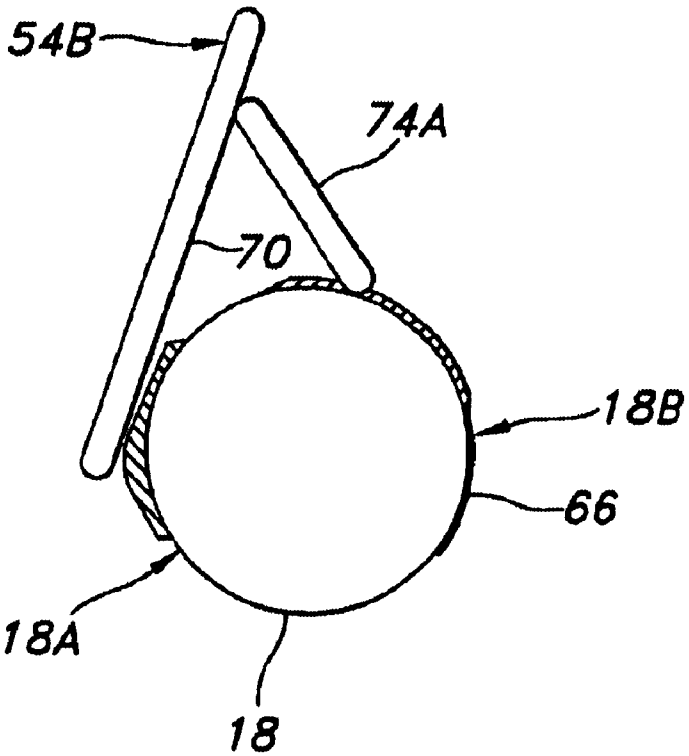
FIG. 6 is a cross-sectional, partially-schematicized view of a portion of the watercraft of FIG. 1 showing a support for a side panel of the protection system.

To deploy panel 54B, corresponding straps 66 are removed, as shown in FIG. 2. Although underside 70 of panel 54B remains attached to leg 18 (as shown in FIG. 6) using straps or other fasteners, removing straps 66 permits panel 54B to expand through inflation. Thereafter, panel 54A is inflated, producing the relatively inflexible structure illustrated in FIG. 6. Clear from FIG. 6 is that panel 54B, when inflated, covers much of exterior side 18A of leg 18 above the waterline. Panel 54B also extends well above the top of leg 18, providing cover for personnel sitting, kneeling, reclining, or possibly even standing in boat 10.

Figure 3:
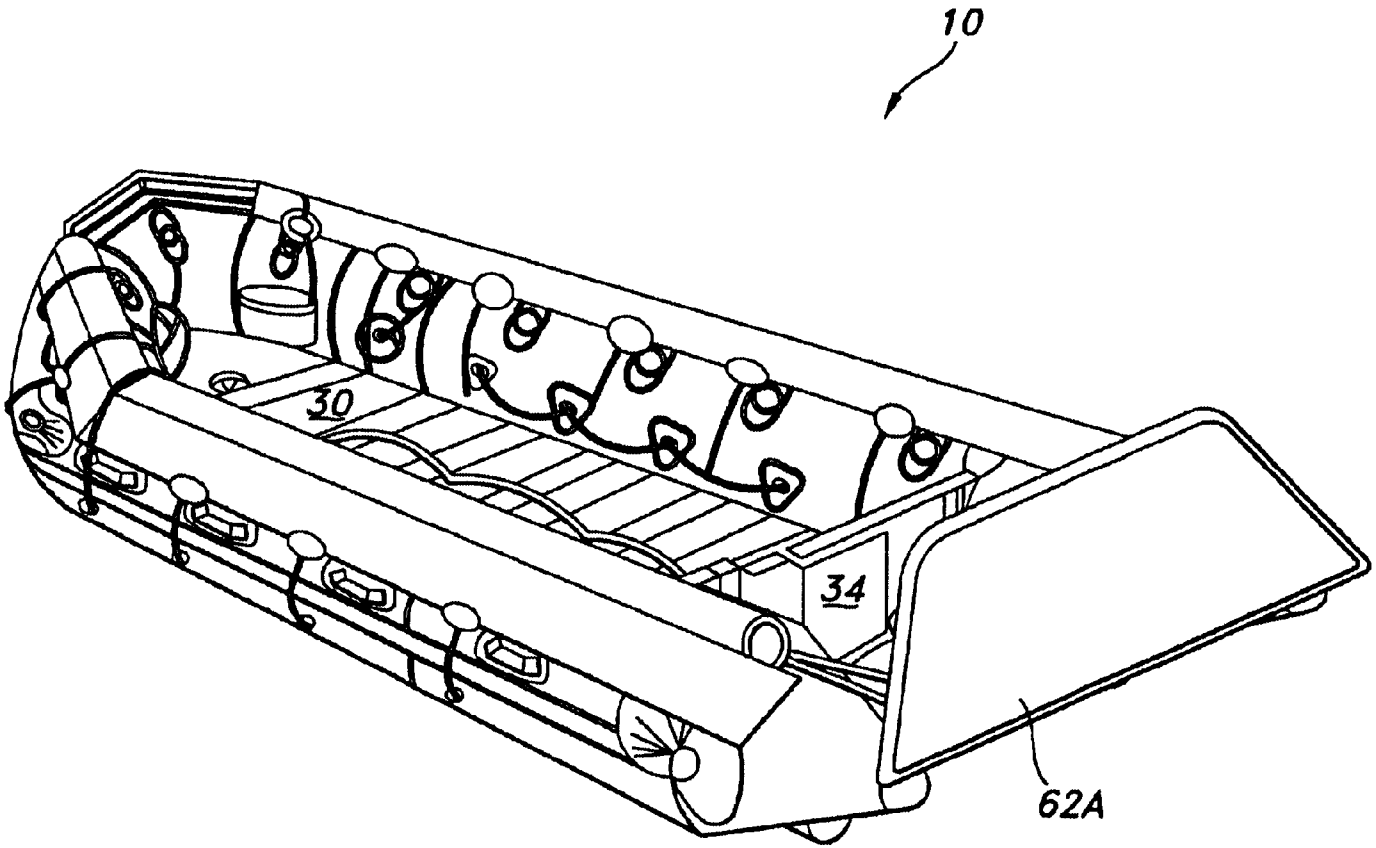
FIG. 3 is a similar view of the watercraft of FIG. 1 with the rear panel of the protection system deployed.
Figure 4:
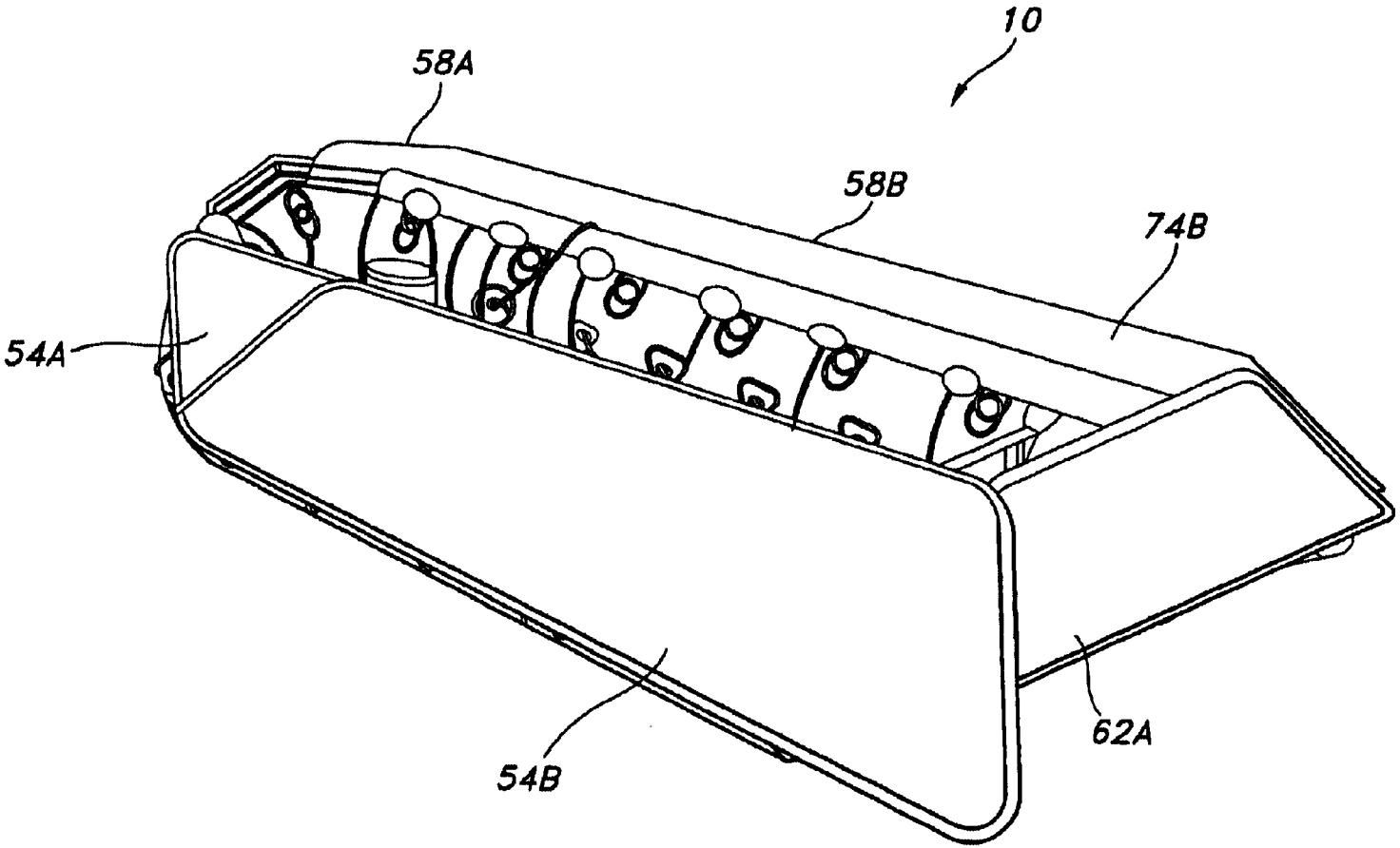
FIG. 4 is a similar view of the watercraft of FIG. 1 with the rear and side panels of the protection system deployed.

Panels 54A, 58A–B, and 62A may be deployed similarly. FIG. 3 depicts rear panel 62A when inflated and deployed as a rear anti-ballistic shield. As so deployed, panel 62A extends sufficiently rearward of transom 34 as to provide some protection for any outboard motor mounted to the transom 34. Straps, ropes, or any other suitable fastening mechanism may be used to connect panel 62A to boat 10. FIG. 4 details exemplary system 50 as fully inflated, with each of panels 54A–B, 58A–B, and 62A designed to provide at least some armored protection of both boat 10 and its occupants from certain projectiles or other hazards.

Illustrated respectively in FIGS. 6 and 4 are support panels 74A and 74B. Although optional, support panels 74A and 74B may be useful in orienting (and maintaining the orientation of) side panels 54B and 58B when those panels are inflated. In particular, because panels 54B and 58B typically extend substantially above the profile of boat 10 (see, especially, FIG. 6), absent support for their upper portions, the panels 54B and 58B may tend to reorient themselves more horizontally under force of gravity. Support panels 74A and 74B are adapted to counteract this effect and maintain panels 54B and 58B generally in the orientations depicted in FIGS. 6 and 4. In some embodiments of system 50, support panels 74A and 74B are inflatable and designed to inflate simultaneously with respective panels 54B and 58B.

Any suitable inflation system may be used to inflate panels 54A–B, 58A–B, 62A, and 74A–B. As noted earlier, various of the panels may be inflated separately. Alternatively, all, or sets of, panels may be designed to inflate concurrently.

Each of panels 54A–B, 58A–B, and 62A may be constructed in any manner and, in certain preferred embodiments, of any components capable of providing at least some protection against certain projectiles. Generically, these types of panels may be called "anti-ballistic shields." Some embodiments of the panels advantageously may incorporate Kevlar (poly-para-phenylene terephthalamide) or other aramid-containing material or high-density foam within (or attached to) a heavy, tear-resistant polyester, polyamide, or other fabric whose exterior surfaces are coated with polyvinyl chloride (PVC) or other material such as Hypalon, Neoprene, or polyurethane. The coated fabric is designed to be substantially impervious to air so as to allow for inflation, and both it and the Kevlar (or other anti-ballistic material) beneficially are selected to be sufficiently flexible to roll, fold, or otherwise collapse for stowage. Preferably, internal stitching within the panel fabric allows inflation to substantial pressure (e.g. 800 mbar) and helps maintain high rigidity thereafter.

Alternatively or additionally, pockets or other containers may be formed in any suitable manner on or in any or all of panels 54A–B, 58A–B, and 62A. Anti-ballistic material (whether flexible or rigid) could be wholly or partially positioned within or enclosed by the pockets and, possibly, even adapted to be removable for repair, replacement, or substitution if desired. Other materials too could either be positioned within the pockets or incorporated into the panels. Non-limiting examples of these materials include energy-absorbing materials to reduce the radar- or other-signature of boat 10 and materials providing protection against weather, environmental, or marine hazards or conditions. Similarly, the pockets themselves could be formed of any of these materials and, perhaps, camouflaged if desired.

Further, because aspects of the invention relate broadly to inflatable support systems for protective or other materials, the object to be protected need not necessarily be boat 10 or any other watercraft. Instead, part or all of innovative system 50 may be adapted for use with other vehicles (such as but not limited to trucks or troop carriers) or stationary objects (such as but not limited to huts or other buildings). Hence, although the foregoing has been provided for purposes of illustrating, explaining, and describing embodiments of the present invention, further modifications and adaptations to these embodiments will be apparent to those skilled in the art and may be made without departing from the scope or spirit of the invention.

What is claimed is:

1. An anti-ballistic shield for an inflatable boat, comprising:

a. inflatable anti-ballistic material; and b. means for attaching the anti-ballistic material to the inflatable boat in a manner providing at least some anti-ballistic protection to inflatable material, and any occupant, of the inflatable boat.

2. An anti-ballistic shield according to claim 1 in which the anti-ballistic material is sufficiently flexible, when undeployed, to be rolled or folded for stowage.

3. An anti-ballistic shield according to claim 2 in which the anti-ballistic material is inflated when deployed.

4. An anti-ballistic shield according to claim 1 in which the anti-ballistic material comprises a plurality of panels.

5. An anti-ballistic shield according to claim 4 further comprising a plurality of support panels.

6. An anti-ballistic shield according to claim 5 in which at least one of the plurality of support panels is inflatable.

7. An anti-ballistic shield for an inflatable boat, comprising:

a. anti-ballistic material comprising:

i. a foam;

ii. fabric at least partially enclosing the foam; and iii. polyvinyl chloride coating on the fabric; and b. means for attaching the anti-ballistic material to the inflatable boat in a manner providing at least some anti-ballistic protection to inflatable material, and any occupant, of the inflatable boat.

8. An anti-ballistic shield according to claim 7 the fabric is polyester.

9. An inflatable anti-ballistic shield for a boat, comprising:

a. inflatable anti-ballistic material; and b. means for attaching the inflatable anti-ballistic material to the boat in a manner providing at least some anti-ballistic protection to any occupant of the boat.

10. An inflatable boat comprising:

a. at least one inflatable tube;

b. an inflatable protection system comprising an anti-ballistic material; and c. means for attaching the inflatable protection system to the at least one inflatable tube.

11. An inflatable boat according to claim 10 in which the inflatable protection system comprises at least one inflatable panel containing the anti-ballistic material.

12. An inflatable boat according to claim 11 in which the at least one inflatable panel comprises at least one inflatable panel positioned at or adjacent the stern of the boat.

13. An inflatable boat according to claim 11 in which the at least one inflatable panel comprises at least one inflatable panel positioned at or adjacent the port or starboard side of the boat.

14. An inflatable boat according to claim 11 in which the at least one inflatable panel comprises:

a. at least one inflatable panel positioned at or adjacent the stern of the boat;

b. at least one inflatable panel positioned at or adjacent the port side of the boat; and c. at least one inflatable panel positioned at or adjacent the starboard side of the boat.

15. An inflatable boat according to claim 14 in which the anti-ballistic material comprises high-density foam, a ceramic plate, or both.

16. An inflatable boat according to claim 15 in which the anti-ballistic material is sufficiently flexible as to be rolled or folded when not inflated.

17. An inflatable boat according to claim 10 in which the at least one inflatable tube defines spaced port and starboard legs, further comprising:

a. a floor spanning the space between the port and starboard legs; and b. a transom spanning the space between the port and starboard legs at or adjacent the stern of the boat.

18. An inflatable boat comprising:

a. at least one inflatable tube defining spaced port and starboard legs;

b. an inflatable protection system comprising an anti-ballistic material;

c. means for attaching the inflatable protection system to the at least one inflatable tube;

d. a floor spanning the space between the port and starboard legs;

e. a transom spanning the space between the port and starboard legs at or adjacent the stern of the boat; and f. at least one fitting attached to the at least one inflatable tube and in which the attaching means comprises at least one fastening strap adapted to be received by the at least one fitting.

19. An inflatable boat comprising:

a. at least one inflatable tube;

b. an inflatable protection system comprising at least one inflatable panel containing an anti-ballistic material comprising foam, a ceramic plate, or both; and c. means for attaching the inflatable protection system to the at least one tube.

20. An inflatable boat according to claim 19 which the anti-ballistic material is sufficiently flexible as to be rolled or folded when not inflated.

21. An inflatable boat defining port and starboard sides, a bow, and a stern, and comprising:

a. at least one inflatable tube defining spaced port and starboard legs;

b. a floor spanning the space between the port and starboard legs; and c. a plurality of inflatable supports, at least one of which when inflated extends above the at least one inflatable tube on the port side and at least another one of which when inflated extends above the at least one inflatable tube on the starboard side.

22. An inflatable boat according to claim 21 in which at least one inflatable support comprises an anti-ballistic material.

23. An inflatable boat according to claim 21 further comprising an additional inflatable support that, when inflated, extends above the at least one inflatable tube at the bow.

24. An inflatable boat according to claim 23 in which the additional inflatable support is in the form of a panel.

25. An inflatable boat according to claim 21 further comprising a transom spanning the space between the port and starboard legs at or adjacent the stern.

* * * * *